US008053966B2

(12) United States Patent
Walker, Jr.

(10) Patent No.: US 8,053,966 B2
(45) Date of Patent: Nov. 8, 2011

(54) CERAMIC SPARK PLUG INSULATOR AND METHOD OF MAKING

(75) Inventor: William J. Walker, Jr., Toledo, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 245 days.

(21) Appl. No.: 12/421,902

(22) Filed: Apr. 10, 2009

(65) Prior Publication Data

US 2009/0256461 A1 Oct. 15, 2009

Related U.S. Application Data

(60) Provisional application No. 61/043,746, filed on Apr. 10, 2008.

(51) Int. Cl.
*H01T 13/20* (2006.01)

(52) U.S. Cl. ..... 313/143; 313/118

(58) Field of Classification Search ..... 313/118–145
See application file for complete search history.

(56) References Cited

U.S. PATENT DOCUMENTS

| | | | | |
|---|---|---|---|---|
| 1,723,026 | A | 8/1929 | Ford | |
| 2,272,618 | A | 2/1942 | Fessler et al. | |
| 2,301,686 | A | 11/1942 | Doran | |
| 2,694,245 | A | 11/1954 | Rogers et al. | |
| 2,863,080 | A | 12/1958 | Bychinsky et al. | |
| 2,867,888 | A | 1/1959 | Schaefer et al. | |
| 2,955,222 | A | 10/1960 | Beesch | |
| 3,013,174 | A | 12/1961 | Logan | |
| 3,295,005 | A | 12/1966 | Poellet et al. | |
| 3,337,668 | A | 8/1967 | Mohle | |
| 4,746,834 | A | 5/1988 | Bauerle et al. | |
| 4,879,260 | A | 11/1989 | Manning | |
| 4,949,006 | A * | 8/1990 | Oshima et al. | 313/144 |
| 5,204,579 | A | 4/1993 | Oshima et al. | |
| 5,477,104 | A | 12/1995 | Tanabe et al. | |
| 5,508,582 | A | 4/1996 | Sugimoto et al. | |
| 7,169,723 | B2 | 1/2007 | Walker | |
| 2005/0122023 | A1 | 6/2005 | Pool | |

FOREIGN PATENT DOCUMENTS

| | | | |
|---|---|---|---|
| GB | 397381 | A | 8/1933 |
| JP | 6333664 | A | 12/1994 |
| JP | 2002246144 | A | 8/2002 |

* cited by examiner

*Primary Examiner* — Anne Hines
(74) *Attorney, Agent, or Firm* — Robert L. Stearns; Dickinson Wright PLLC

(57) ABSTRACT

An insulator for a spark ignition device is disclosed which includes an electrically insulating ceramic core tube having a terminal end, a firing end and an inner bore which extends along a longitudinal bore axis from the terminal end to the firing end and an electrically insulating, ceramic core nose tube having a second outer surface and a second bore where the second outer surface of said ceramic core nose tube is in nested engagement with and directly bonded to the bore of the ceramic core tube proximate the firing end. The insulator also may include a similarly nested and directly bonded shoulder tube on an outer surface of the core tube, or a nested and directly bonded mast tube on an outer surface of the core tube. The ceramics may include alumina-based ceramics, as well other suitable ceramic materials, and the tube may be made from the same ceramic compositions or different ceramic compositions. The invention also includes a method of making the nested tube, directly boded insulators by controlling shrinkage during sintering.

13 Claims, 10 Drawing Sheets

FIG. 3
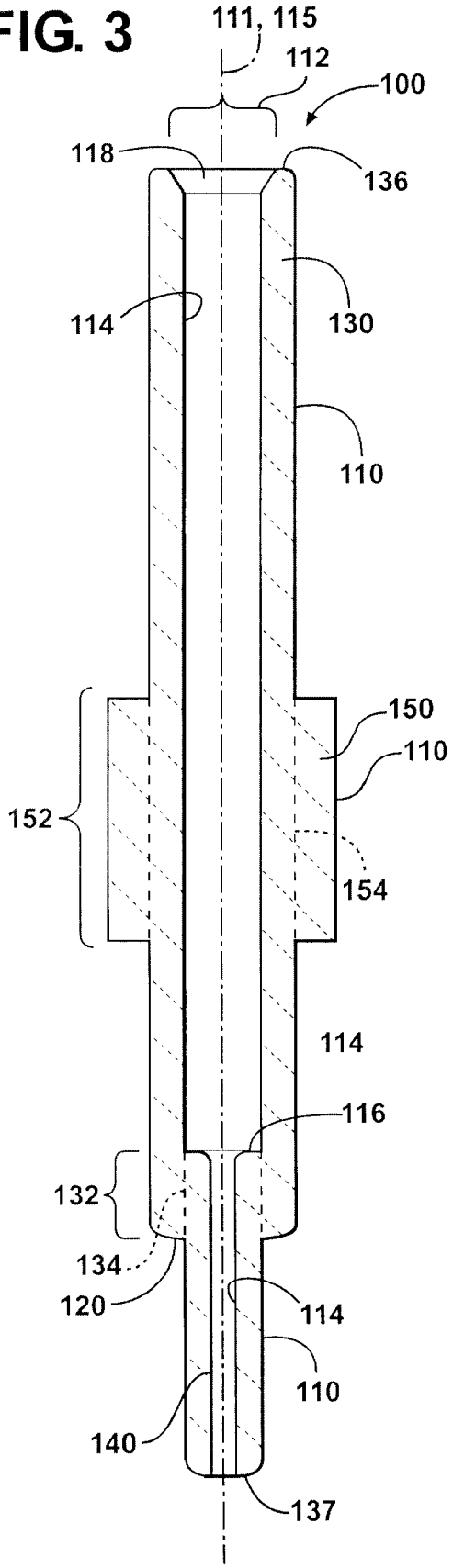
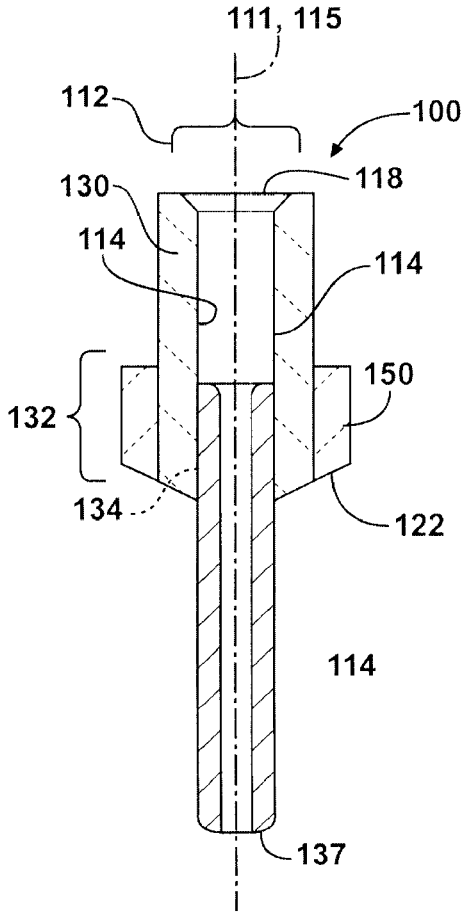
FIG. 4

FIG. 8A
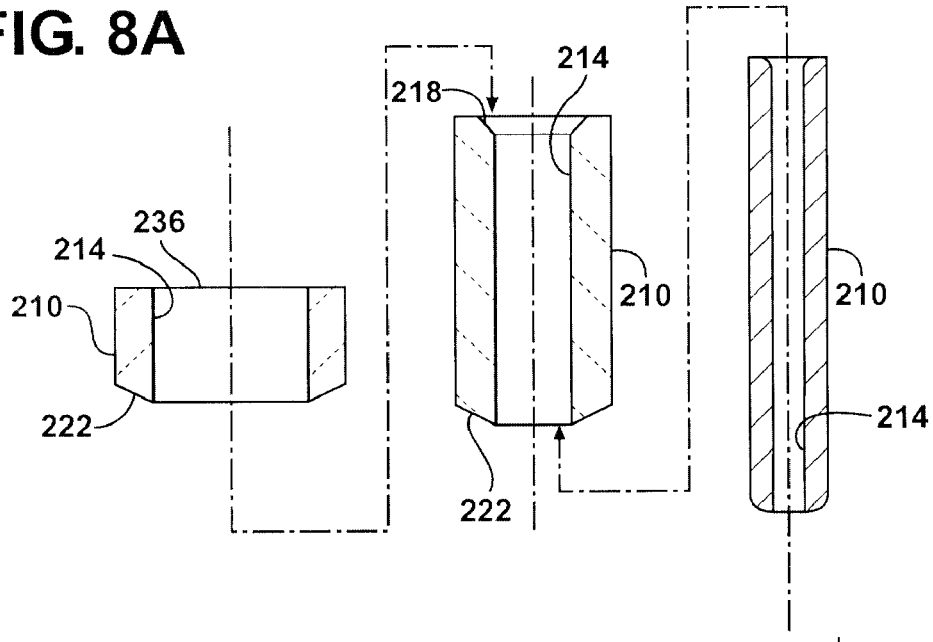
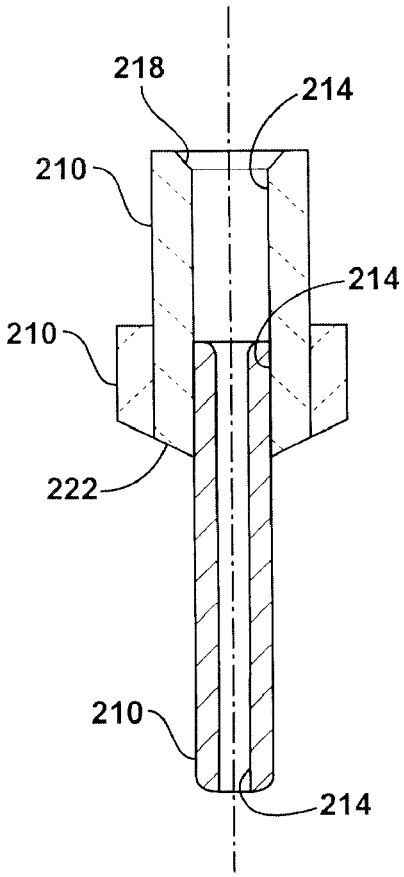
FIG. 8B
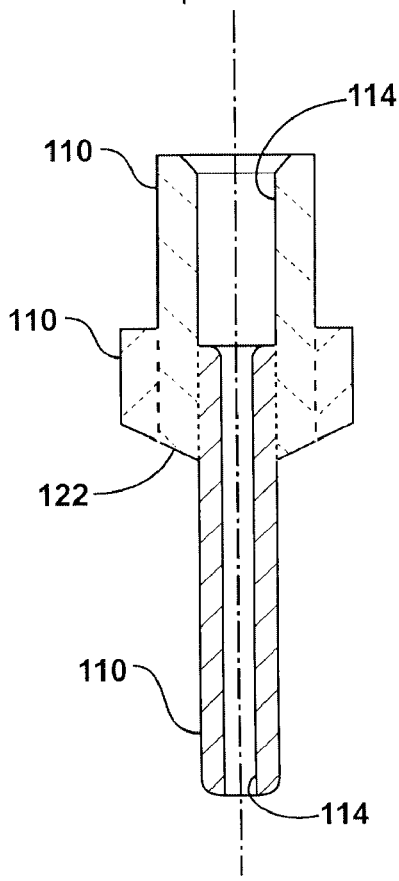
FIG. 8C

CERAMIC SPARK PLUG INSULATOR AND METHOD OF MAKING

CROSS REFERENCE TO RELATED APPLICATIONS

This application claims priority to Provisional Patent Application No. 61/043,746 filed Apr. 10, 2008, the entire disclosure of which is hereby incorporated by reference and relied upon.

BACKGROUND OF THE INVENTION

1. Field of the Invention

The present invention relates generally to ceramic insulators, and more particularly to ceramic spark plug insulators and methods of making ceramic spark plug insulators.

2. Related Art

As illustrated in FIG. 1, conventional spark plugs 10 generally utilize a ceramic insulator 12 which is partially disposed within a metal shell 16 and extends axially above the metal shell toward a terminal end 18. A conductive terminal 20 is disposed within a central bore 22 at the terminal end 18. The conductive terminal 20 is part of a conductive center electrode assembly 24 disposed within the central bore 22. At the opposite or firing end 26, a center electrode 28 is disposed within the insulator 12 and has an exposed sparking surface 30 which together with ground electrode 32 disposed on the shell 16 defines a spark gap 34. Many different insulator 12 configurations are used to accommodate a wide variety of terminal configurations, electrode assembly configurations, shell configurations and the like. However, referring to FIGS. 1 and 2, the features of insulator 12 are representative of conventional contemporary spark plug insulators generally.

Insulator 12 is a monolithic ceramic article which is typically made by pressing a blank from spray-dried powder and subsequently grinding a near-net shape insulator preform (which allows for shrinkage) from the blank using a grinding wheel, and then firing the insulator preform to a high temperature sufficient to densify the preform and sinter the powder particles to form the finished insulator. Insulator 12 has a mast portion 36 that extends above shell 16 which is adapted to receive a spark plug boot (not shown) and which has a wall thickness sufficient to provide the necessary mechanical strength to the insulator, as it may experience stresses associated with handling and installation of the spark plug. Mast portion 36 houses a terminal stud 37 in the central bore 22 as shown, and in other configurations (not shown), may also house other portions of center electrode assembly 24. Insulator 12 also includes large shoulder 38 which is used in conjunction with turn-over 40 to retain insulator 12 within metal shell 16 during operation of an engine as pressure associated with the combustion gases presses outwardly against the insulator 12 and center electrode assembly 24. Insulator 12 also has a lower cylindrical portion 42 disposed in metal shell 16 proximate the threaded portion 43 of the shell.

Lower cylindrical portion 42 houses a three part (conductor/suppressor/conductor) glass fired in suppressor seal (FISS) 44 in the central bore 22 as shown, or in other configurations, another portion of center electrode assembly 24. Lower cylindrical portion 42 transitions through small shoulder 45 to a tapered core nose 46 disposed on a lower portion thereof. Small shoulder 45 is operative to engage shoulder 47 in shell 16, and together with large shoulder 38 and turn over 40 (or in other shell configurations (not shown) a preformed flange or shoulder) retains insulator 12 in shell 16. Tapered core nose 46 houses the center electrode 28 which may also include a sparking tip (not shown) as the sparking surface 30. Insulators 12 have a high dielectric strength, high mechanical strength, high thermal conductivity, and resistance to thermal shock sufficient for the high-temperature operating environment of an internal combustion engine.

Spark plug insulators used in internal combustion engines are subjected to high temperature environments in the region of about 1,000° C. In operation, ignition voltage pulses of up to about 40,000 volts are applied through the spark plug to the center electrode, thereby causing a spark to jump the gap between the center and ground electrodes. The purpose of the insulator is to ensure the integrity of the spark path and prevent the voltage pulses from finding other paths to ground, thereby diminishing the sparking performance of the plug. The high voltage and high temperature environment described can either degrade the performance of existing insulator materials or highlight performance limits associated with these materials. For example, the pressing processes leaves relics of the spray-dried powder which are known to have a detrimental effect on dielectric strength of the ceramic, since the cross-sectional area of the pressed blank is not uniform along its length in order to accommodate the shape of the insulator. Density gradients may be present so that some regions of the insulator are of lower density (higher porosity).

Referring again to FIG. 1, density gradients and regions of lower density frequently occur using the pressing methods described above at locations where the cross-sectional thickness of the insulator changes, such as either side of large shoulder region 38, or the region adjacent to small shoulder 45. These regions of reduced density have a lower dielectric strength, hence they are more susceptible to dielectric breakdown. As another example, the grinding processes used to form spark plug insulators remove a large amount of material from the pressed blanks. This material is typically reprocessed into subsequent batches of spray-dried powder, but is also a potential source of contamination. Such contamination can also introduce random, localized regions of reduced dielectric strength within the ceramic materials used for spark plug insulators. As another example, the grinding processes used to form the insulators also leave a relatively rough surface finish on the sintered insulator, which typically necessitates glazing of the terminal end or mast of the insulator, and promotes adhesion of deposits from the combustion process on the firing end.

Many different materials have been used or proposed for use in ceramic spark plug insulators, including various porcelains and metal oxides. Currently, the most commonly used materials are alumina-based ceramic materials, which also typically incorporate various glasses and other alloying constituents. Examples of alumina-based ceramic materials suitable for use as ceramic spark plug insulators include those described in U.S. Pat. No. 4,879,260 (Manning) and U.S. Pat. No. 7,169,723 (Walker). The ceramic materials used for the insulator are dielectric materials. Dielectric strength of a material is generally defined as the maximum electric field which can be applied to the material without causing breakdown or electrical puncture thereof. The dielectric strength of spark plug insulators is generally measured in volts per mil (V/mil). A typical value for spark plug RMS dielectric strength for a standard spark plug design used in many applications is on the order of about 400 V/mil at room temperature. Dielectric strength of the insulators used in spark plugs is also a function of temperature. High temperatures cause an increase in the mobility of certain ions allowing current to more easily leak through the ceramic. Any leakage of current leads to localized heating which gradually degrades the resistance of the material to dielectric puncture. It has been observed that resistance of insulators to dielectric breakdown also tends to decrease over the life of a spark plug due to thermal stress on the spark plug cycling under an applied electric field and due to attendant thermal-electrical fatigue thereof. The exact nature of the microstructural and/or compositional changes are not completely understood, but are believed to be associated with localized heating to temperatures sufficient to bring about partial melting of the ceramic material.

As manufacturers continue to increase the complexity and reduce the size of internal combustion engines, spark plug insulators are needed that have a smaller diameter. Currently, size reduction is constrained due to the required dielectric strength of the insulator over the service lifetime of the plug, which is directly related to the thickness required for the walls of the insulator. Another factor limiting size reduction is that more manufacturers are demanding a longer service lifetime from spark plugs such as requesting 100,000 mile, 150,000 mile, and 175,000 mile service lifetimes from spark plugs. The longer the desired service lifetime, the higher the required dielectric strength. Also, the higher the required voltage, the higher required dielectric strength. Previously to increase the service lifetime or dielectric strength of a spark plug the walls of the insulator were increased in thickness. However, the current demand for more compact spark plugs for modern engines prevents or limits the use of thicker walled insulators. Therefore, as engines shrink in size and as longer service lifetimes and higher voltages are needed in spark plugs, a spark plug having an insulator with an increased dielectric strength and a reduced wall thickness and size is needed.

Therefore, for a spark plug insulator of a given size and wall thicknesses, it would be desirable to increase the dielectric strength and thereby reduce the susceptibility to dielectric breakdown during extended periods of service at high voltages and high operating temperatures in order to promote enhanced spark plug, and thus engine, performance. Alternately, for a given performance requirement, it would be desirable to increase the dielectric strength of the insulator material and thereby promote reduction of the size and wall thicknesses of the insulator material, thereby reducing the space envelope associated with the spark plug and enabling use of this space for other purposes.

SUMMARY OF THE INVENTION

High purity alumina has been found to have exceptional electrical properties, with RMS dielectric strength of 475 V/mil. This is an improvement of about 20% over the alumina used for conventional spark plug insulators. However, high-purity alumina is difficult to process, and the manufacturing technology used for conventional spark plug insulators may not be adequate. For example, the conventional forming technology is to press a blank from spray-dried powder and subsequently grind the profile of the insulator into the blank using a grinding wheel, and then fire the insulator to high temperature to densify by sintering. The pressing process leaves relics of the spray-dried powder which are known to have a detrimental effect on dielectric strength of the ceramic. Since the cross sectional area of the pressed blank is not uniform in order to accommodate the shape of the insulator, density gradients may be present so that some regions of the insulator are of lower density and more prone to dielectric failure. The grinding process removes a large amount of material. This material is typically reprocessed into subsequent batches of spray-dried powder but is a potential source of contamination. The grinding process also leaves a fairly rough surface on the insulator, which necessitates glazing of the terminal end, and promotes adhesion of deposits from the combustion process on the firing end. The present invention is a spark plug insulator that is formed by the assembly of two or more roughly cylindrical components before firing, which are permanently joined during the firing process.

The components that are assembled to form the spark plug insulator can be made by any of the commonly used processes used in ceramics. Extrusion is a very efficient method of forming the type of cylindrical components that are used in the present invention. Extruded parts are easily formed and do not have a relic structure from compacted granular material as is found in dry pressed insulators. Extrusion also produces parts of very uniform density. Some of the alumina ceramic parts that have been measured to have the highest dielectric strength were formed by extrusion. Extruded parts are formed to close tolerances on the inside and outside diameters with little waste. By assembling a spark plug insulator by the assembly of two or more extruded tubes that nest within each other, the shape of a spark plug insulator can be obtained. By controlling the density of the individual extruded components, they can be made to shrink during firing in such a way that the joints are strong and gas tight.

BRIEF DESCRIPTION OF THE DRAWINGS

FIG. 3 is a cross-sectional view of an assembled insulator portion for a spark plug according to a first embodiment of the subject invention;

FIG. 4 is a cross-sectional view of an alternative embodiment of a spark plug insulator assembled according to this invention;

FIGS. 8A-C depict, in sequence, the assembly and formation of a spark plug insulator like that shown in FIG. 4;

DETAILED DESCRIPTION OF THE PREFERRED EMBODIMENT

Figure 1:
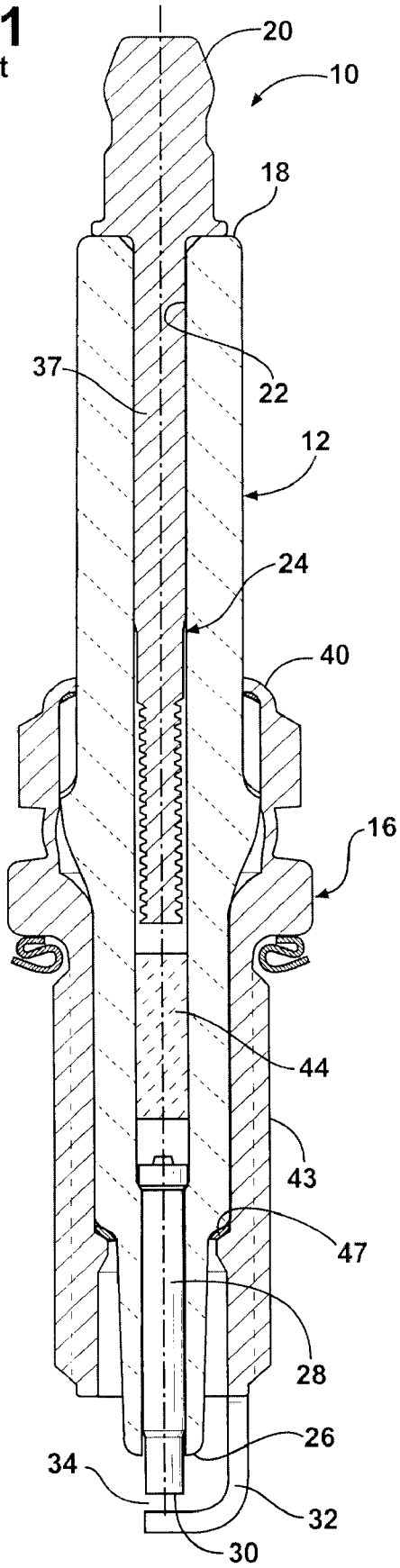
FIG. 1 Prior Art
FIG. 1 is a simplified cross-sectional view of a spark plug according to the prior art.
Figure 2:
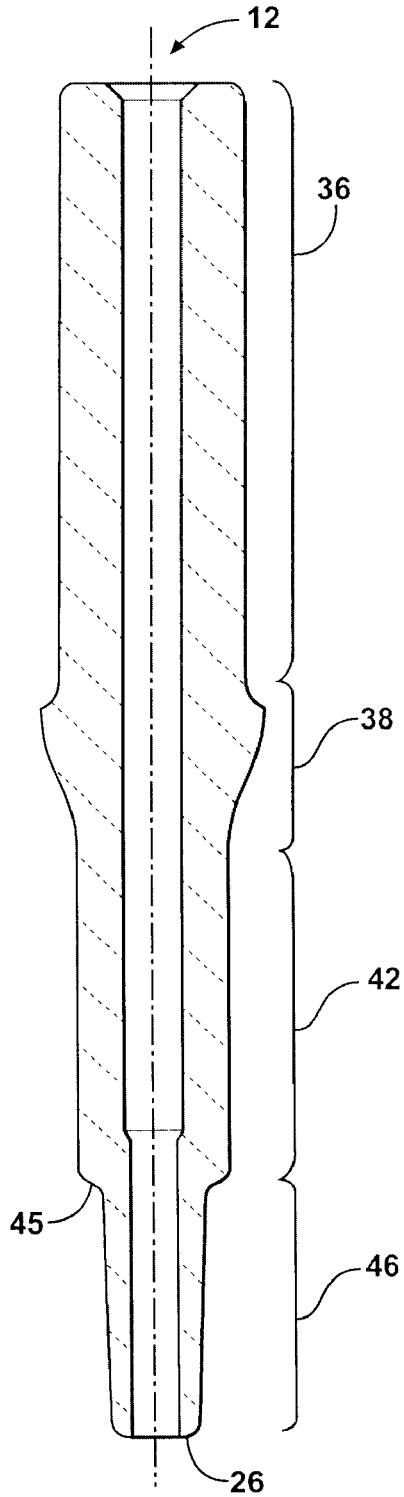
FIG. 2 Prior Art
FIG. 2 is a cross-sectional view of the insulator portion of the spark plug depicted in FIG. 1.

Referring to FIGS. 3-10, the present invention is a ceramic spark plug insulator 100 which includes a plurality of ceramic tubes 110 which are in nesting engagement and directly bonded to one another by sintering green ceramic preform tubes 210 to form ceramic spark plug insulator 100. Green ceramic preform tubes 210 and the resulting ceramic tubes 110 may have any suitable shape, including a right cylindrical shape which is favorable for obtaining and maintaining nested engagement, and may utilize any suitable outer diameter 112 or outer measurement, including those of a wide variety of conventional spark plug insulators. However, it is believed that the present invention is particularly well adapted as insulators for use with small diameter spark plugs, such as those having a thread size of M12, M10 and smaller for the reasons set forth herein related to the fact that the ceramic insulators 100 of the invention may be manufactured using materials and processes which will obtain relatively higher density, or higher dielectric strength, or both of them, than have been obtained for monolithic ceramic insulators. Additionally, ceramic tubes 110 may incorporate a bore 114 formed as a bore preform 214 in the green ceramic preform tube 210. Bore 114 may extend along longitudinal bore axis 115 which may coincide with a longitudinal central axis 111 of ceramic tube 110. If multiple bores 114 are employed, the multiple bore axes 115 may or may not coincide with the tube axis 111. Bore 114 may be formed in the manner described to any suitable diameter or size for housing any type of center electrode assembly (not shown). For example, by appropriate sizing of the bores 114 within nested ceramic tubes 110, a shoulder 116 or plurality of shoulders 116 may be incorporated to engage, retain or otherwise house components of a center electrode assembly (not shown), such as a center electrode, FISS, spring, resistor capsule, inductor, terminal stud, terminal or the like. Additionally, one or more counterbores (not shown) may be formed within bore preform 214 by grinding or like fowling processes to form additional shoulders, tapers, lead-in or other features therein which, upon sintering, provide these features within bore 114. Green ceramic preform tubes 210 may also be ground or otherwise formed on their respective ends or outer surfaces to provide relief in the form of various chamfers 218, radii 220, tapers 222, grooves (not shown) or other features which, upon sintering, provide chamfers 118, radii 120, tapers 122, grooves (not shown) or other features.

Referring to FIGS. 3-6, ceramic spark plug insulator 100 includes a core tube 130. Generally speaking, core tube 130 is an electrically insulating ceramic tube 110 which is in nesting engagement with and directly bonded to the majority of the other ceramic tubes 110, as illustrated in FIGS. 3-6. While this is the general arrangement of the elements, the invention is not so limited, as other arrangements of the ceramic tubes described herein which are in nesting engagement and directly bonded, without the incorporation of core tube 130, may be possible. Core tube 130 has a terminal end 136 which is operative to house a spark plug terminal and a firing end 137 which is opposite the terminal end and operative for orientation proximate the cylinder head. The use of the terms terminal end and firing end are used throughout with respect to various ceramic tubes and tube preforms to describe their orientation relative to core tube 130. Core tube 130 will have a length, outer diameter, bore diameter and thus a wall or tube thickness determined by many factors, including the thread size and shell configuration of the spark plug into which it is to be incorporated, the required dielectric strength, mechanical strength, heat transfer and ceramic material(s) used, as well as other factors. Without limitation, it is believed that the length of core tube 130 may vary in the range of about 0.50-3.00 inches, the diameter may vary in a range of 0.25-0.50 inches, and that the wall thickness may range from about 0.050-0.100 inches for many applications. However, applications falling outside these ranges are also possible and within the scope of this invention.

Referring again to FIGS. 3-6, core tube 130 is in nesting engagement with and directly bonded to core nose tube 140. The overlap 132, which provides nested engagement, and direct bond 134 form a gas tight seal between these tubes. The length of overlap 132 for a particular insulator 100 design will depend on sealing, joint strength, heat transfer, electrode assembly materials and configuration and other considerations and requirements associated with the joint between these tubes for a particular insulator and spark plug design, such as the diameter of the core nose tube 140. It is believed that an overlap of about 0.25 inches or more will provide sufficient overlap for many insulator 12 designs. By directly bonded, it is meant that the bond 134 is the result of the sintering process only, with out the introduction of an intermediate layer, such as a glass or glaze, such that intimate contact exists at the interface between the outer surface of core nose tube 140 and the bore 114 of core tube 130 in the overlap 132. It is believed that the sintering process produces some chemical bonding at this interface, with the degree of bonding being dependent upon the sintering time and temperature and other factors, such as the presence of contamination at the interface, the surface finish of the parts in the overlap 132, wall thicknesses and densities of the respective preforms and the like. Core nose tube 140 will have a length, outer diameter, bore diameter and thus a wall or tube thickness determined by many factors, including the thread size and shell configuration of the spark plug into which it is to be incorporated, the required dielectric strength, mechanical strength, heat transfer and ceramic material(s) used, and the like characteristics of core tube 130, as well as other factors. Without limitation, it is believed that the length of core nose tube 140 may vary in the range of about 0.25-1.25 inches, the diameter may vary in a range of 0.20-0.26 inches, and that the wall thickness may range from about 0.050-0.100 inches for many applications. However, applications falling outside these ranges are also possible and within the scope of this invention.

Figure 5:
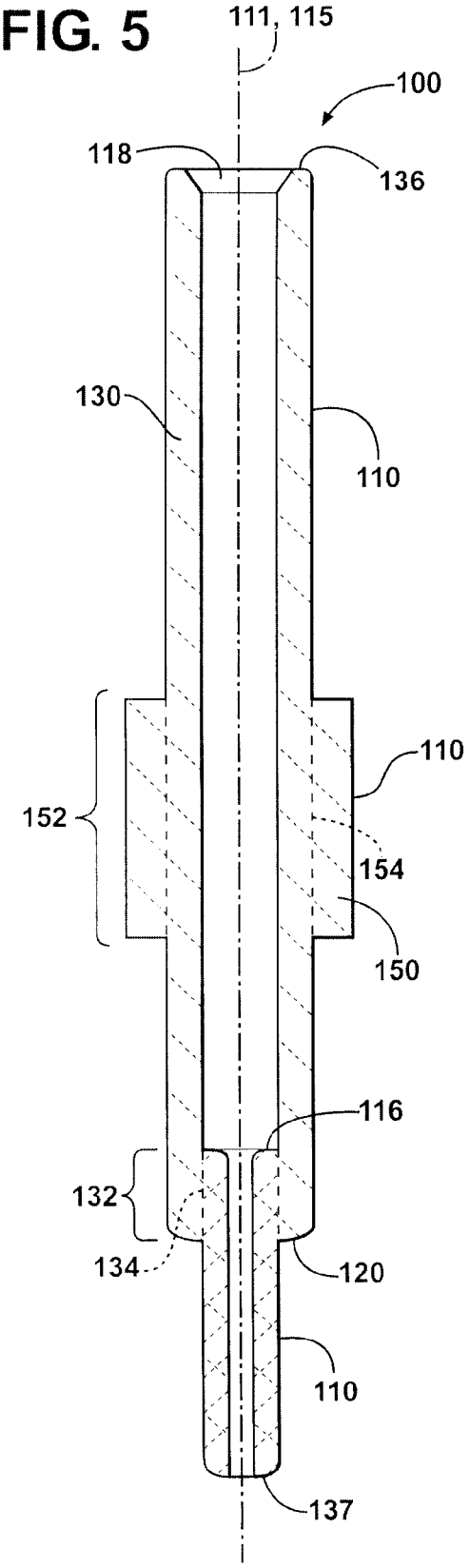
FIG. 5 is an assembled view of a spark plug according to yet another alternative embodiment of the invention.
Figure 6:
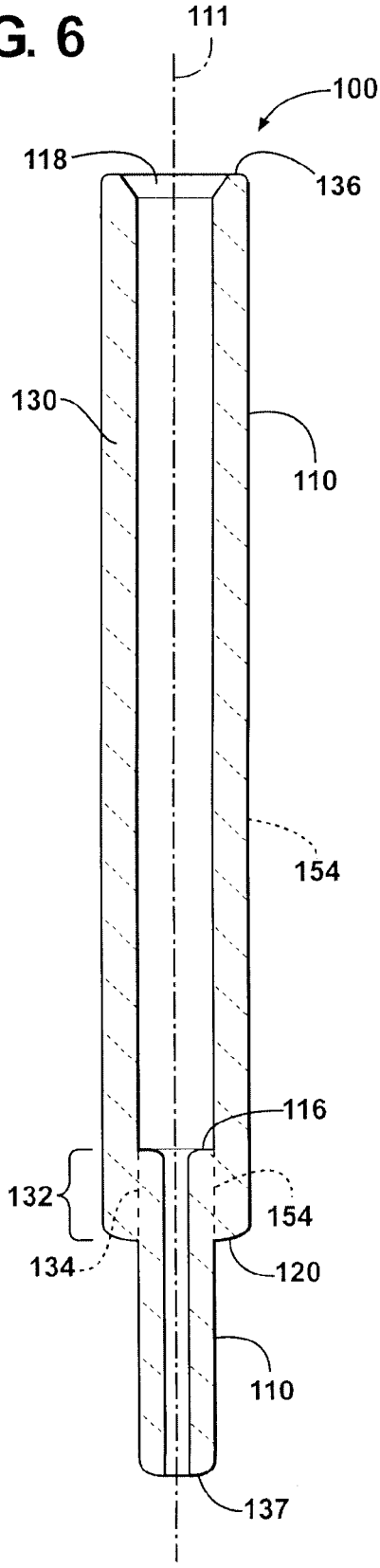
FIG. 6 is a cross-sectional view of an insulator according to a still further embodiment of this invention.
Figure 7A:
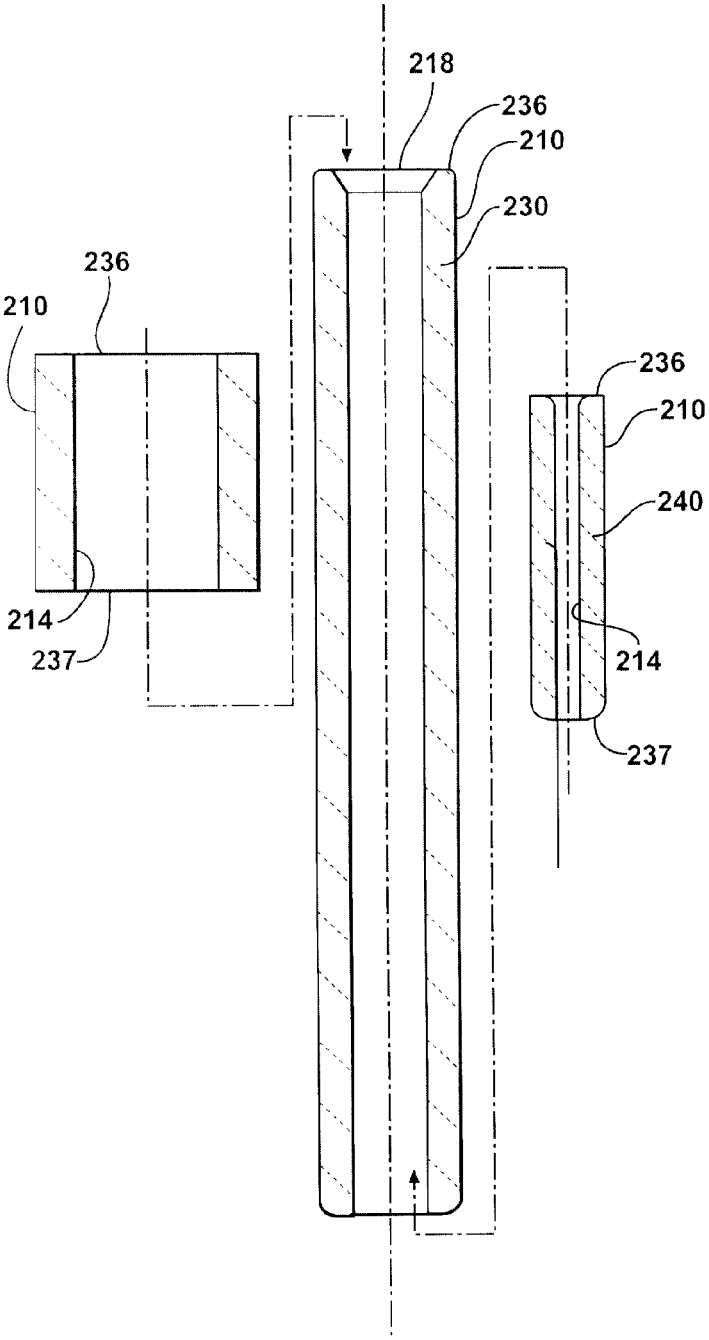
FIGS. 7A-C depict, in sequence, the assembly and formation of a spark plug insulator like that shown in FIG. 3.
Figure 7B:
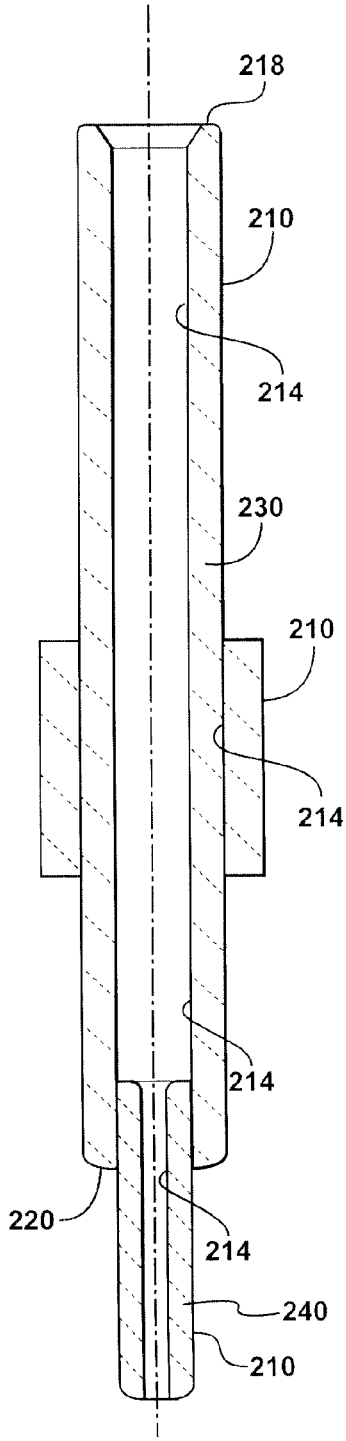
Figure 7C:
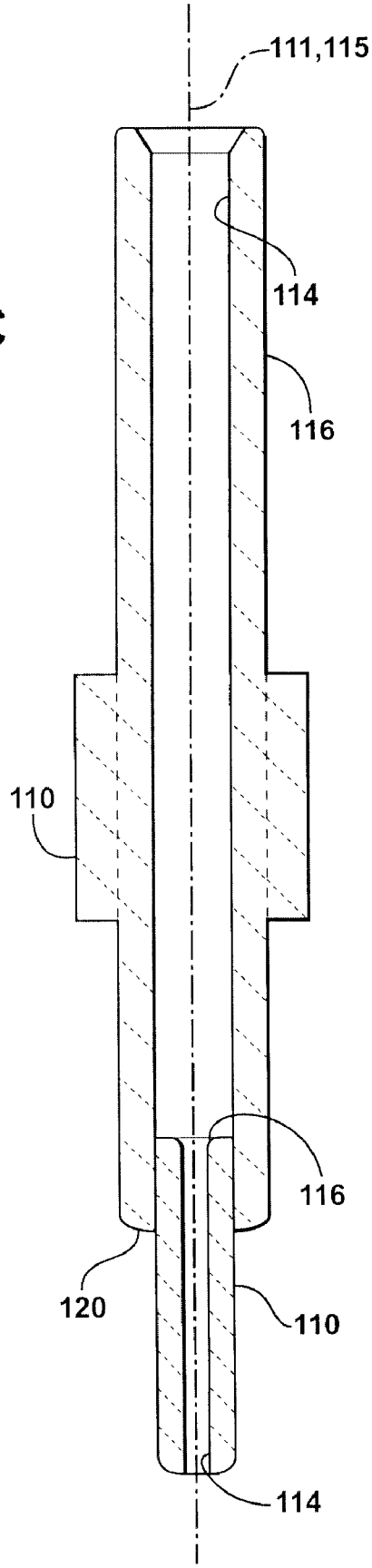
Figure 9A:
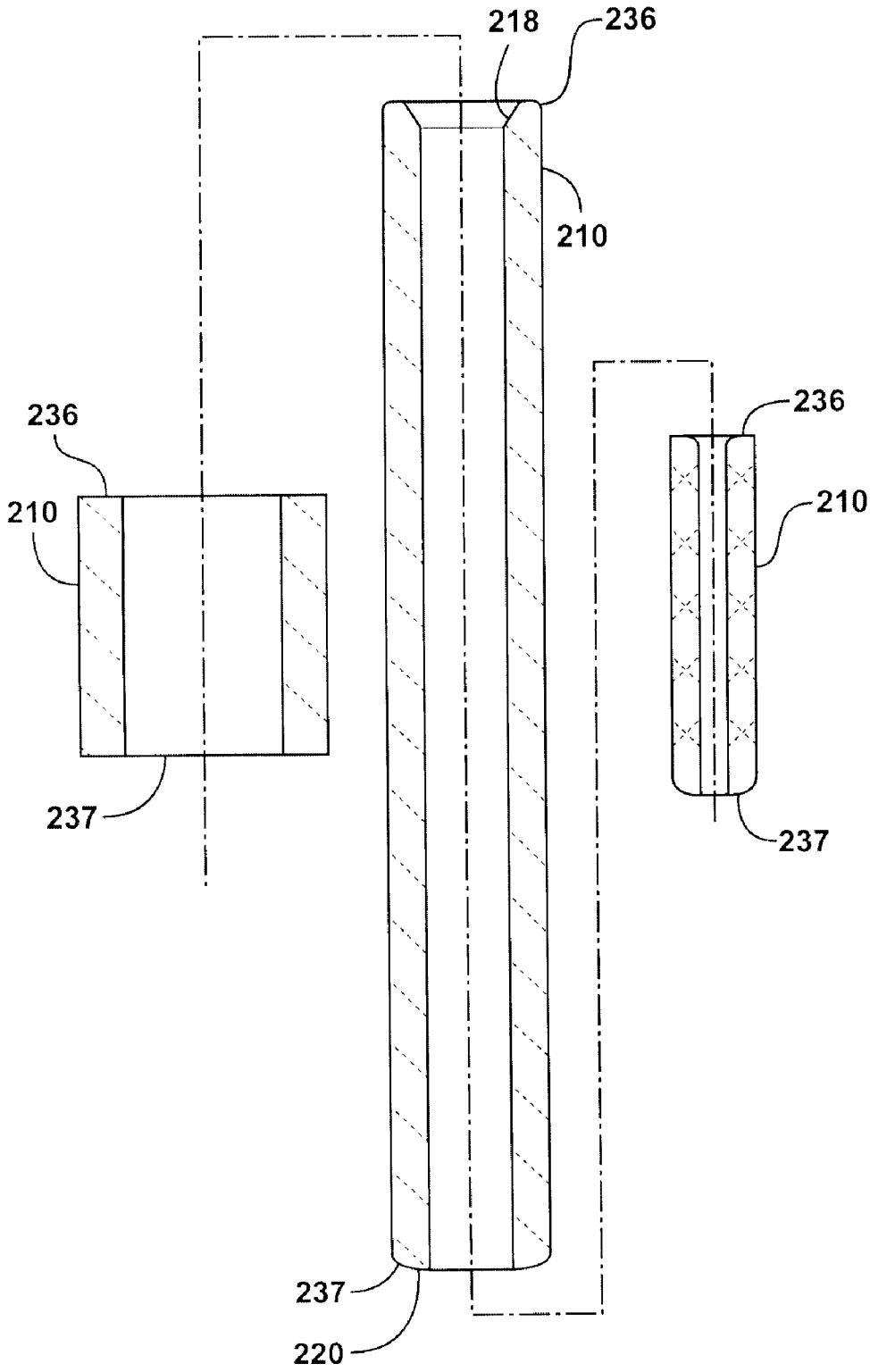
FIGS. 9A-C depict, in sequence, the assembly and formation of a spark plug insulator like that shown in FIG. 5.
Figure 9B:
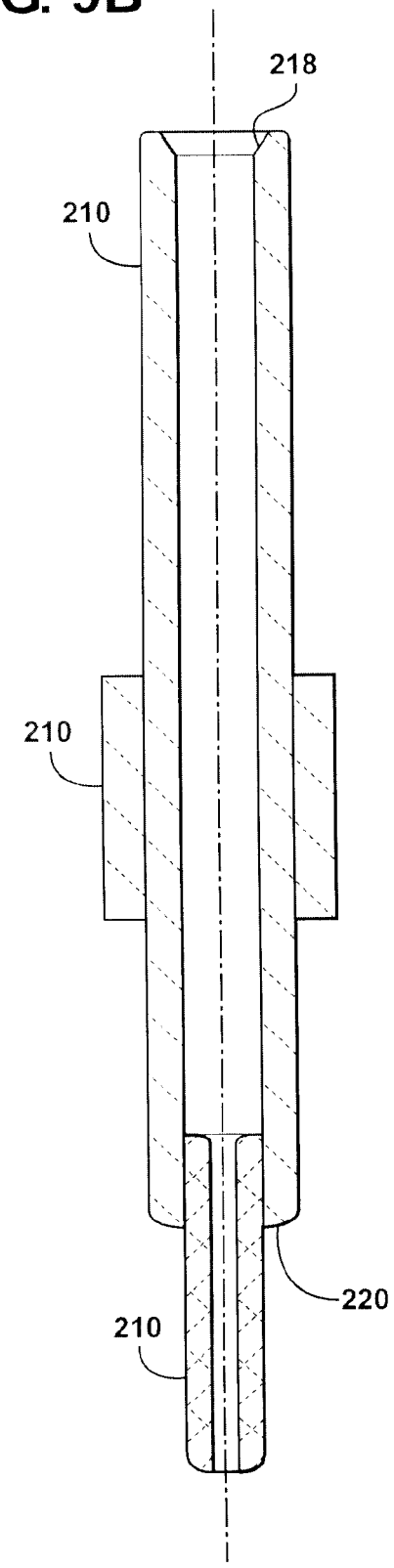
Figure 9C:
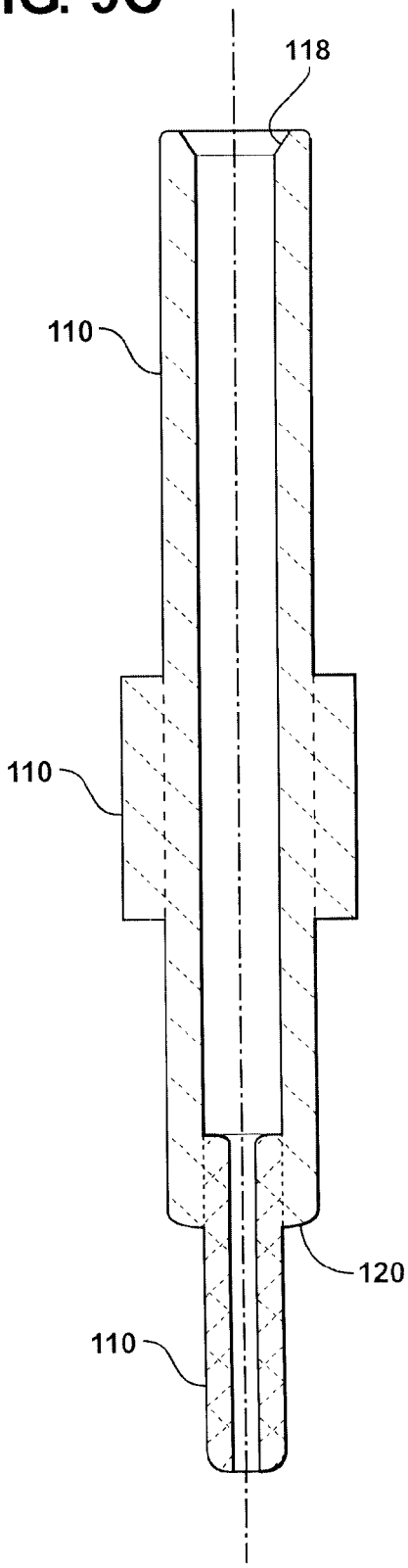
Figure 10A:
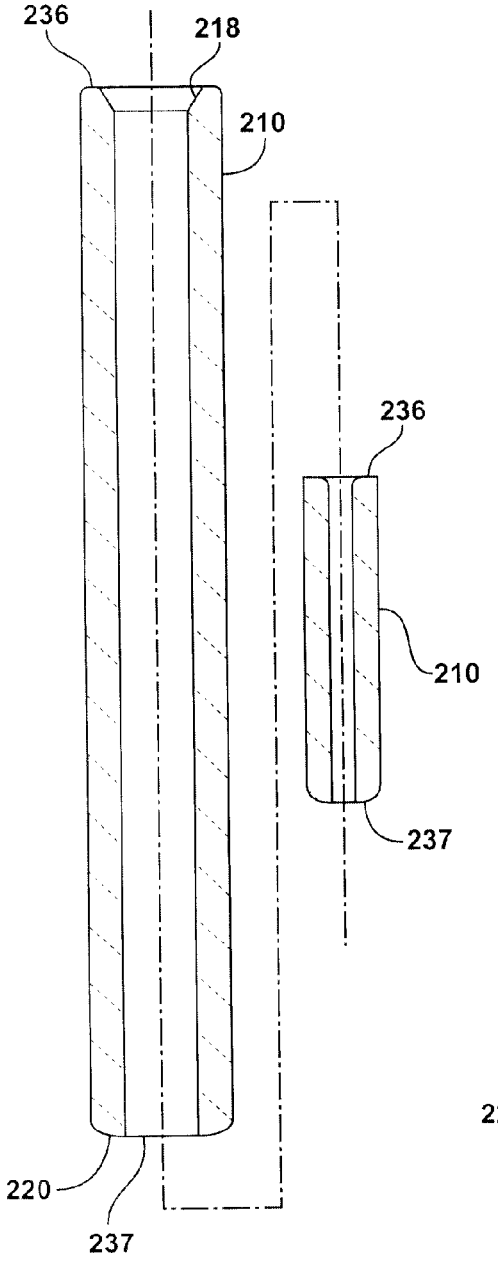
FIGS. 10A-C depict, in sequence, the assembly and formation of a spark plug insulator like that shown in FIG. 6.
Figure 10B:
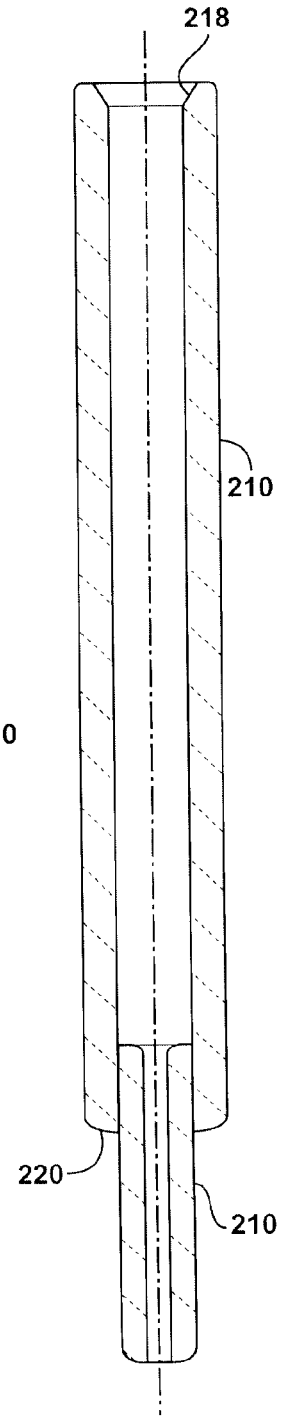
Figure 10C:
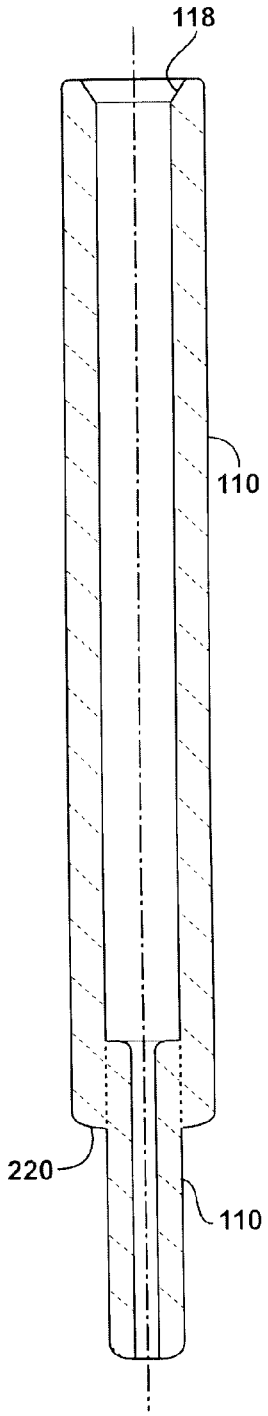

Referring to FIGS. 3-5, insulator 100 may also include a shoulder tube 150 located along the outer surface of core tube 130, generally in a midsection of core tube 130. Core tube 130 is in nesting engagement with and directly bonded to shoulder tube 150. The overlap 152, which provides nested engagement, and direct bond 154 form a gas tight seal between these tubes. Similarly to the considerations for the joint between core tube 130 and core nose tube 140, the length of overlap 152 for a particular insulator 100 design will depend on sealing, joint strength, heat transfer, shell materials and configuration and other considerations and requirements associated with the joint between these tubes for a particular insulator and spark plug design, such as the shear strength requirements in cases where shoulder tube 150 functions as the large shoulder of the insulator in a conventional shell where shoulder tube 150 is in engagement with a turn over as a means for retaining insulator 100 in a shell. It is believed that an overlap 152 of about 0.125 inches or more will provide sufficient overlap 152 for many insulator 12 designs. Directly bonded has the same meaning for bond 154 as described previously, although the degree of bonding may vary from that of bond 134 due to differences in the factors described above associated with the respective joints. Shoulder tube 150 will have a length, outer diameter, bore diameter and thus a wall or tube thickness determined by many factors, including the thread size and shell configuration of the spark plug into which it is to be incorporated, the required dielectric strength, mechanical strength, heat transfer and ceramic material(s) used, and the like characteristics of core tube 130, as well as other factors. Without limitation, it is believed that the length of shoulder tube 150 may vary in the range of about 0.125-0.750 inches, the diameter may vary in a range of 0.350-0.550 inches, and that the wall thickness may range from about 0.040-0.100 inches for many applications. However, applications falling outside these ranges are also possible and within the scope of this invention.

Figure 11:
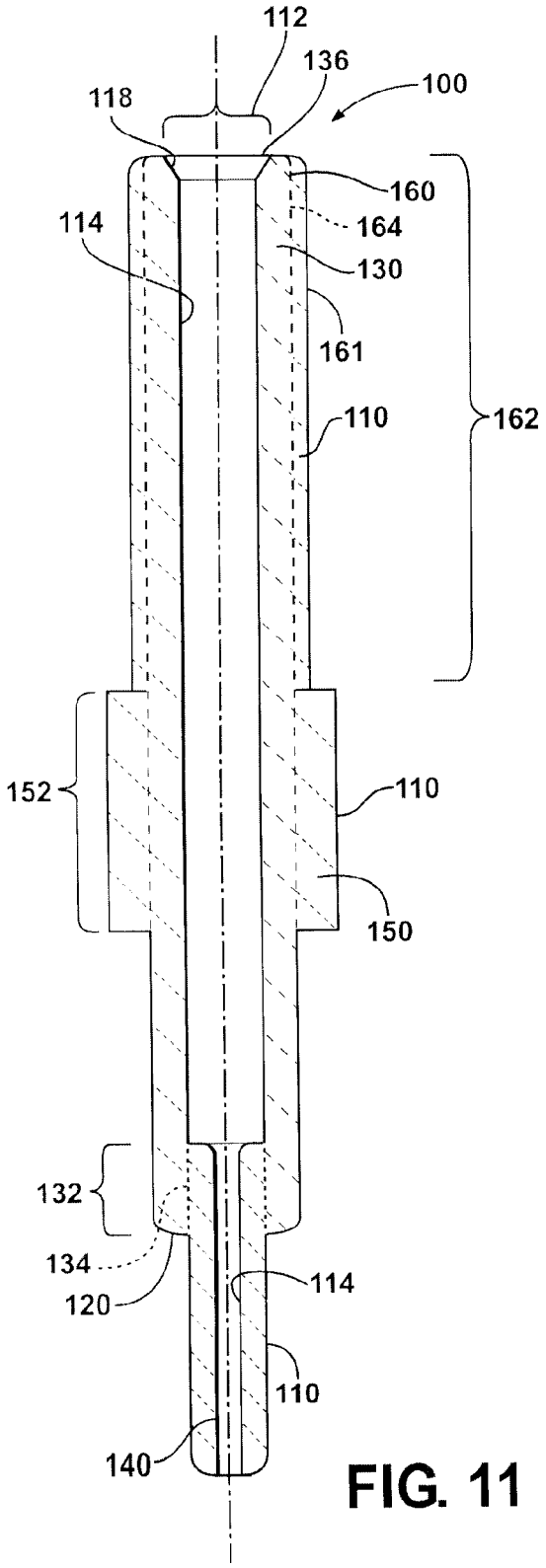
FIG. 11 is a cross-sectional view of another alternative embodiment of this invention including a bonded mast tube.

Referring to FIG. 11, a mast tube 160 may also be applied to any of the examples of insulator 100 shown in FIGS. 3-6; however, FIG. 11 illustrates the addition of a mast tube 160 to the design illustrated in FIG. 3. Mast tube 160 may be used to increase the wall thickness of the mast portion 161 of insulator 100 so as to provide greater mechanical strength, or for other considerations. Mast tube 160 is located along the outer surface of core tube 130, generally in an upper portion of the outer surface of core tube 130. It may be coextensive with the terminal end 136 of core tube 130 as shown, or may extend beyond or terminate beneath terminal end 136 (not shown). Core tube 130 is in nesting engagement with and directly bonded to mast tube 160. The overlap 162, which provides nested engagement, and direct bond 164 form a gas tight seal between these tubes. Similarly to the considerations for the joint between core tube 130 and core nose tube 140, the length of overlap 162 for a particular insulator 100 design will depend on mechanical strength, heat transfer, terminal shape and configuration and other considerations and requirements associated with the joint between these tubes for a particular insulator and spark plug design, such as the bending strength requirements of this portion of insulator 100. It is believed that overlap 162 will generally vary with the length of the mast portion of insulator 100. Directly bonded has the same meaning for bond 164 as described previously, although the degree of bonding may vary from that of bond 134 due to differences in the factors described above associated with the respective joints. Mast tube 160 will have a length, outer diameter, bore diameter and thus a wall or tube thickness determined by many factors, including the thread size and shell configuration of the spark plug into which it is to be incorporated, the required dielectric strength, mechanical strength, heat transfer and ceramic material(s) used, and the like characteristics of core tube 130, as well as other factors. Without limitation, it is believed that the length of mast tube 160 may vary in the range of 0.5-2.0 inches, the diameter may vary in a range of 0.350-0.500 inches, and that the wall thickness may range from about 0.050-0.150 inches for many applications. However, applications falling outside these ranges are also possible and within the scope of this invention.

Ceramic tubes 110 may be made from any suitable electrically insulating ceramic materials, including any conventional ceramic material use as a spark plug insulator, such as, for example, the alumina-based ceramic materials described in U.S. Pat. No. 4,879,260 (Manning) and U.S. Pat. No. 7,169,723 (Walker), which are hereby incorporated by reference herein in their entirety. In addition, however, the methods which may be used to form the green ceramic preforms 210 enable the utilization of ceramic materials not utilized in conventional spark plug insulators, such as alumina-based ceramic compositions having greater than 98.5% by weight of alumina. These high purity alumina compositions have an RMS dielectric strength of up to 475 V/mil, which is an improvement of about 20% over conventional alumina-based ceramic compositions. It is believed that the present invention also may enable the use of new ceramic materials for insulator 100, including various metal nitrides and metal oxynitrides, such as silicon nitride, aluminum nitride, aluminum oxynitride, various solid solutions of alumina and aluminum nitride, as well as high purity polycrystalline alumina. Some of these materials are known to have one or more of the required insulator properties, including high temperature mechanical strength, dielectric strength, impact strength, thermal conductivity and thermal shock resistance, which is superior to that of conventional alumina-based ceramic compositions, but which are not suitable for processing using conventional manufacturing equipment and methods used to form spark plug insulators, such as those described herein, and thus are not used for this purpose, or are considered to be too costly due to material usage, waste and other manufacturing consideration associated with conventional insulator designs. Similarly, it is believed that some of these ceramic compositions may also provide the required properties sufficient to enable, or otherwise be advantageous for, the implementation of new insulator designs of the present invention. Such as those shown in FIG. 6, where a core tube having a substantially uniform wall thickness along its length is used, in contrast to conventional designs where the wall thickness of the mast portion (see above and mast portion 161 of FIG. 11) is generally thicker than the lower portion.

The present invention also enables the use of more than one ceramic composition for ceramic insulator 100. For example, ceramics having higher thermal conductivity than alumina, such as silicon nitride, aluminum nitride, aluminum oxynitride, various solid solutions of alumina and aluminum nitride and high purity polycrystalline alumina may be employed together with alumina, or any combination of the members of the group described above.

Figure 12:
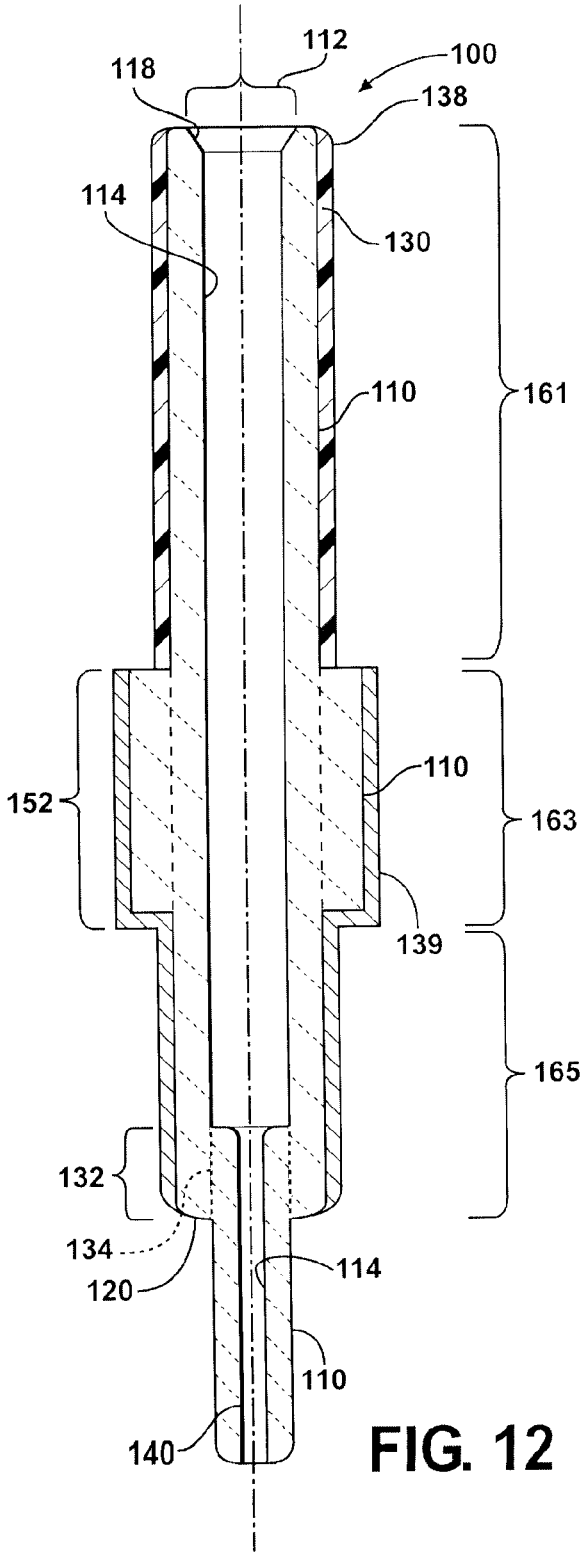
FIG. 12 is a cross-sectional view of the spark plug insulator of FIG. 3 including an insulating coating and a conductive coating applied to various regions of the exterior surface.

Referring to FIG. 12, an insulating coating 138 may also be applied to any of the examples of insulator 100 shown in FIGS. 3-6 and 11; however, FIG. 12 illustrates the addition of an insulating coating to the design illustrated in FIG. 3. The insulating coating 138 may be applied to all or any portion of the surfaces of insulator 100, including all or any portion of the outer surface, bore or the respective ends. As an example, an insulating coating 138 may be applied to the mast portion 161 to increase the resistance of the spark plug in which insulator 100 is incorporated to flashover during its operation. Any suitable insulating coating may be used, including various glazes, glasses, silicones and the like.

Referring again to FIG. 12, an electrically and/or thermally conductive coating 139 may also be applied to any of the examples of insulator 100 shown in FIGS. 3-6 and 11; however, FIG. 12 illustrates the addition of a conductive coating 139 to the design illustrated in FIG. 3. The conductive coating 139 may be applied to all or any portion of the surfaces of insulator 100, including all or any portion of the outer surface, bore or the respective ends. As an example, a conductive coating 139 may be applied to the large shoulder region 163 and lower portion 165 to increase the thermal conductivity of the outer surface and improve the ability to remove heat from insulator 100 to the spark plug shell where it can then be removed to the cylinder head during operation of the spark plug. Any suitable conductive coating may be used, including coatings of various pure metals and metal alloys and conducting ceramic materials.

Referring to FIGS. 7-10, a method of making a spark plug insulator is illustrated as a plurality of steps which include forming a green ceramic core tube preform 230 having a terminal end 236, an opposite or firing end 237 and an inner bore preform 214; forming a green ceramic core nose tube preform 240; nesting the core nose tube 240 preform within the firing end 237 of the core tube preform 230 to form an overlap between them; and firing the core tube preform 230 and the core nose tube preform 240 at a temperature and for a time sufficient to sinter them and form a direct bond between them in the overlap to form the sintered spark plug insulator body. The forming may be done for either of the tube preforms using any suitable method for forming green ceramic preforms, including dry pressing or extrusion of a ceramic powder. Nesting involves insertion of one tube into another.

The mating portions will typically be sized to permit then to be overlapped as illustrated, this may involve establishing touching contact or creation of a very slight interference.

The ceramic composition used for extrusion is a paste which typically contains ceramic particles, water, and a small amount of a temporary organic binder material such as methylcellulose. Extrusion forms a continuous tube that must be cut to sections of the appropriate length to make spark plug insulators. Since the extruded tubes may be soft and deformable, it may be desirable to remove the water by a drying process before cutting to the desired length and nesting them together. The tube performs may also be fired to a temperature that is lower than the final sintering temperature before nesting. Of course, it is not necessary all of the tubes are fired to the same degree of completion. For example, it may be preferable to fire one or more tubes to, or very close to final sintering temperature. This may be of particular value if the core nose tube is a different material composition which requires a higher sintering temperature to achieve the desired final density, such as alumina, aluminum nitride, aluminum oxide or silicon nitride for examples.

The green ceramic preforms for all of the preform tubes described herein will generally be formed to a relative density that is in the range of about 50-65% of theoretical full density for the particular ceramic material of interest, with a more preferred range believed to be about 55-65% of theoretical density. The direct bonding of the nested green ceramic tubes occurs as the mating surfaces in the nested or overlapping portions are maintained in intimate contact during the sintering process. In the limit, this intimate contact may constitute touching contact with a relatively small compressive contact forces or contact pressure at the interface. However, it is preferred that nested green ceramics be selected and fired so as to develop hoop stresses as the nested tubes shrink that tend to increase the contact pressure at the interface, thereby ensuring intimate contact and facilitating some degree of chemical bonding of the ceramics at the interface.

During sintering, the tubes shrink as their porosity is reduced and the material in the tubes increases in density. The factors that determine the shrinkage include, the geometry (i.e., the diameters and wall thicknesses), material composition and the density of green ceramic tubes. While control of either the geometry or material selection of the tubes alone, or both together, may be used to provide the desired compressive forces. Desirable compressive forces may be established by selection and control of the relative densities of the green ceramic tube preforms, either alone or together with these other factors. For preforms of a given size and using the same sintering conditions, a lower relative density produces greater shrinkage in the sintered tubes. Therefore, in order to develop the desired compressive forces, for a given nested coupling, it is desirable that the less dense green ceramic tube be the outermost tube and the more dense tube be the innermost tube. Further, it is desirable for a given coupling of the same green ceramic materials, that the relative density differential be in the range of about 1-5%. If different materials having different shrinkage properties are used for the coupling, or having geometric differences that affect the shrinkage considerations, this range may be adjusted to account for the influence of the other factors.

The method may also include a step of applying an insulating coating to an outer surface of the spark plug insulator body after it has been sintered using the materials described above followed by heating the insulating coating for a temperature and time sufficient to bond the insulating coating to the outer surface of the insulator.

The method may also include forming a green ceramic shoulder tube preform, wherein the step of nesting also includes nesting the ceramic shoulder tube preform on the outer surface of the ceramic core tube in a second overlap, and the step of firing also sinters and directly bonds the ceramic shoulder tube preform to the ceramic core tube preform in the second overlap. Likewise, the method may also include a step of forming a green ceramic mast tube preform, wherein the step of nesting also includes nesting the ceramic mast tube preform on the outer surface of the ceramic core tube in a third overlap, and the step of firing also sinters and directly bonds the ceramic mast tube preform to the ceramic core tube preform in the third overlap.

FIGS. 3-6 and 11 illustrate only a few of the spark plug insulator 100 configurations possible in accordance with this invention. It will be readily appreciated that many other configurations are possible, including configurations which are similar in size, shape, wall thicknesses and other features to many conventional monolithic spark plug insulators, as well as a wide variety of new sizes, shapes and insulator 100 configurations.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly, the scope of legal protection afforded this invention can only be determined by studying the following claims.

What is claimed is:

1. An insulator for a spark ignition device, comprising:

an electrically insulating ceramic core tube having a terminal end, a firing end and an inner bore which extends along a longitudinal bore axis from said terminal end to said firing end;

an electrically insulating, ceramic core nose tube having an outer surface and an inner bore, said outer surface of said ceramic core nose tube is in nested engagement with and directly bonded to said inner bore of said ceramic core tube proximate said firing end; and said ceramic core tube having a density which is substantially constant along said longitudinal bore axis from said terminal end to said firing end.

2. The insulator of claim 1, wherein said insulator has an outer surface having a surface roughness that varies from said terminal end to said firing end.

3. The insulator of claim 1 further comprising an insulating coating located on an upper portion of said outer surface.

4. The insulator of claim 1, further comprising an insulating coating located on a lower portion of said outer surface.

5. The insulator of claim 1, wherein at least one of said ceramic tubes have a relieved portion on said terminal end or said firing end in any combination.

6. The insulator of claim 5, wherein each of said tubes has an outer surface, and said relieved portion of said tube is located on said outer surface or within said bore of said tube in any combination.

7. The insulator of claim 1, wherein said bore has a plurality of diameters.

8. The insulator of claim 7, wherein the plurality of diameters are progressively reduced from said terminal end to said firing end.

9. The insulator of claim 1, wherein said ceramic core tube and said core nose tube comprise different compositions of ceramic materials.

10. The insulator of claim 9, wherein said core nose tube has final density which is different from the final density of said ceramic core tube.

11. An insulator for a spark ignition device, comprising:

an electrically insulating ceramic core tube having a terminal end, a firing end and an inner bore which extends along a longitudinal bore axis from said terminal end to said firing end;

an electrically insulating, ceramic core nose tube having an outer surface and an inner bore, said outer surface of said ceramic core nose tube is in nested engagement with and directly bonded to said inner bore of said ceramic core tube proximate said firing end; and wherein said outer surfaces have a surface roughness that are substantially the same from said terminal end to said firing end.

12. An insulator for a spark ignition device, comprising:

an electrically insulating ceramic core tube having a terminal end, a firing end and an inner bore which extends along a longitudinal bore axis from said terminal end to said firing end;

an electrically insulating, ceramic core nose tube having an outer surface and an inner bore, said outer surface of said ceramic core nose tube is in nested engagement with and directly bonded to said inner bore of said ceramic core tube proximate said firing end; and an electrically insulating ceramic shoulder tube having an inner bore, said inner bore of said shoulder tube in nested engagement with and directly bonded to said outer surface of said ceramic core tube.

13. An insulator for a spark ignition device, comprising:

an electrically insulating ceramic core tube having a terminal end, a firing end and an inner bore which extends along a longitudinal bore axis from said terminal end to said firing end;

an electrically insulating, ceramic core nose tube having an outer surface and an inner bore, said outer surface of said ceramic core nose tube is in nested engagement with and directly bonded to said inner bore of said ceramic core tube proximate said firing end; and a ceramic mast tube having an outer surface and an inner bore, said inner bore of said ceramic mast tube is in nested engagement with and directly bonded to said outer surface of said core tube proximate said terminal end.

* * * * *